US006142689A

United States Patent [19]

Margiotta

[11] Patent Number: 6,142,689

[45] Date of Patent: Nov. 7, 2000

[54] ENVELOPE LEVELER FOR PRINTER FEEDER

[75] Inventor: Al Margiotta, Plainview, N.Y.

[73] Assignee: Olympus America, Inc., Melville, N.Y.

[21] Appl. No.: 09/358,575

[22] Filed: Jul. 21, 1999

[51] Int. Cl.[7] ..... B41J 13/12

[52] U.S. Cl. ..... 400/624; 400/629

[58] Field of Search ..... 400/626, 629, 400/624, 634; 271/117, 148, 2

[56] References Cited

U.S. PATENT DOCUMENTS

| | | | |
|---|---|---|---|
| 5,052,673 | 10/1991 | Tokuda et al. | 271/117 |
| 5,419,543 | 5/1995 | Nakamura et al. | 400/624 |
| 5,419,645 | 5/1995 | Russo | 400/624 |
| 5,480,247 | 1/1996 | Saikawa et al. | 400/624 |
| 5,511,773 | 4/1996 | Burger | 271/148 |
| 5,520,381 | 5/1996 | Lo et al. | 271/117 |
| 5,755,433 | 5/1998 | Klein | 271/2 |

FOREIGN PATENT DOCUMENTS

| | | | |
|---|---|---|---|
| 0078013 | 5/1984 | Japan | 10/86 |

*Primary Examiner*—John S. Hilten
*Assistant Examiner*—Anthony H. Nguyen
*Attorney, Agent, or Firm*—Scully, Scott, Murphy & Presser

[57] ABSTRACT

An envelope leveler for use with a printer feeder to orient a top envelope of a stack of envelopes to be fed into a printer attached to the printer feeder. The envelope leveler including: a platform upon which the envelope stack is disposed; a base; and a pivot for rotating the platform and the envelope stack thereupon about the base such that the top envelope of the envelope stack is oriented for proper feeding into the printer. Also provided is a printer having the envelope leveler. The printer comprising: a printer feeder having a surface for supporting the stack of envelopes; a feeder for feeding the top envelope into the printer; and an envelope leveler comprising a platform upon which the envelope stack is disposed, a base, and a pivot means for rotating the platform and the envelope stack thereupon about the base such that the top envelope of the envelope stack is oriented for proper feeding into the printer.

8 Claims, 5 Drawing Sheets

ENVELOPE LEVELER FOR PRINTER FEEDER

BACKGROUND OF THE INVENTION

1. Field of the Invention

The field of art to which this invention relates is printers, in particular, an envelope leveler for a high volume printer having a top-feeder in which envelopes are fed into the printer.

2. Description of the Related Art

In printers of the prior art, particularly those which employ a top-feeder for storing and feeding a top envelope from a stack of envelopes into the printer, the envelope stack presents a problem in that the top envelope is not properly oriented for feeding into the printer. The improper orientation of the top envelope of the envelope stack is due to the tendency of a stack of envelopes to be higher at one side then the other side.

A typical printer 100 of the prior art having such a top-feeder paper feed arrangement is shown in FIG. 1. The top-feeder 102 generally includes a paper tray 103 and employs a pick roller 104 for contacting and feeding the top envelope 106 from the top of the envelope stack 108 into the printer 100. A gearbox and motor assembly 110 drive the pinch roller as necessary to feed the top envelope 106. Since the height of the envelope stack is uneven, as is shown in FIG. 1, the pick roller 104, which is generally located in the center of the envelope stack along a central axis C—C, does not efficiently engage and feed the top envelope 106 into the printer 100.

Furthermore, since the top envelope 106 is skewed with respect to the pick roller 104, one of its ends 108*a* is elevated over the other end 108*b*, causing the top envelope 106 to rotate while feeding into the printer 100, resulting in improper feeding and a subsequent paper jam.

Devices are known in the prior art to account for the uneven height of an envelope stack which is to be fed into a printer. While these devices have their advantages, they are generally complex and costly, such as that disclosed in U.S. Pat. No. 5,520,381 to Lo et al. Their complexity and cost also make them difficult, if not impossible, to retrofit onto existing printers. The prior art devices also do not account for a varying degree of unevenness in an envelope stack.

Another prior art solution to the problem has been to manipulate the envelopes themselves to eliminate the unevenness in the height of the envelope stack. U.S. Pat. No. 4,807,805 to Rutkowski creates an assembly of two envelopes of uniform thickness that can be torn apart after printing. U.S. Pat. No. 4,915,288 to Kao et al. adds a flat sheet of adhesive to the individual envelopes of an envelope stack to make them a uniform thickness. U.S. Pat. No. 5,755,433 to Klein prints on flat unfolded sheets which are folded into envelopes after printing.

For these reasons an envelope leveler is needed which is simple, inexpensive, easy to retrofit onto existing printers and accounts for the degree of unevenness in a stack of envelopes to be fed into a printer, particularly one which employs a top-feeder system.

SUMMARY OF THE INVENTION

Therefore, it is an object of the present invention to provide a simple envelope leveler for a printer.

It is a further object of the present invention to provide an inexpensive envelope leveler for a printer.

It is a further object of the present invention to provide an envelope leveler which is easily retrofitted onto existing printers.

It is still yet another object of the present invention to provide an envelope leveler which easily accounts for varying degrees of unevenness of envelope stacks to be fed into a printer.

Accordingly, an envelope leveler is provided. The envelope leveler of the present invention is for use with a printer feeder to orient a top envelope of a stack of envelopes to be fed into a printer attached to the printer feeder. The envelope leveler comprises: a platform upon which the envelope stack is disposed; a base; and a pivot means for rotating the platform and the envelope stack thereupon about the base such that the top envelope of the envelope stack is oriented for proper feeding into the printer.

Also provided is a printer having the envelope leveler of the present invention. The printer comprises: a printer feeder having a surface for supporting the stack of envelopes; means for feeding the top envelope into the printer; and an envelope leveler comprising a platform upon which the envelope stack is disposed, a base, and a pivot means for rotating the platform and the envelope stack thereupon about the base such that the top envelope of the envelope stack is oriented for proper feeding into the printer.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENTS

Although this invention is applicable to numerous and various types of printers and printing medium, it has been found particularly useful in the environment of printers employing a top-feeder in which envelopes are being fed into the printer. Therefore, without limiting the applicability of the invention to top-feeder printers and envelopes, the invention will be described in such environment.

Figure 1:
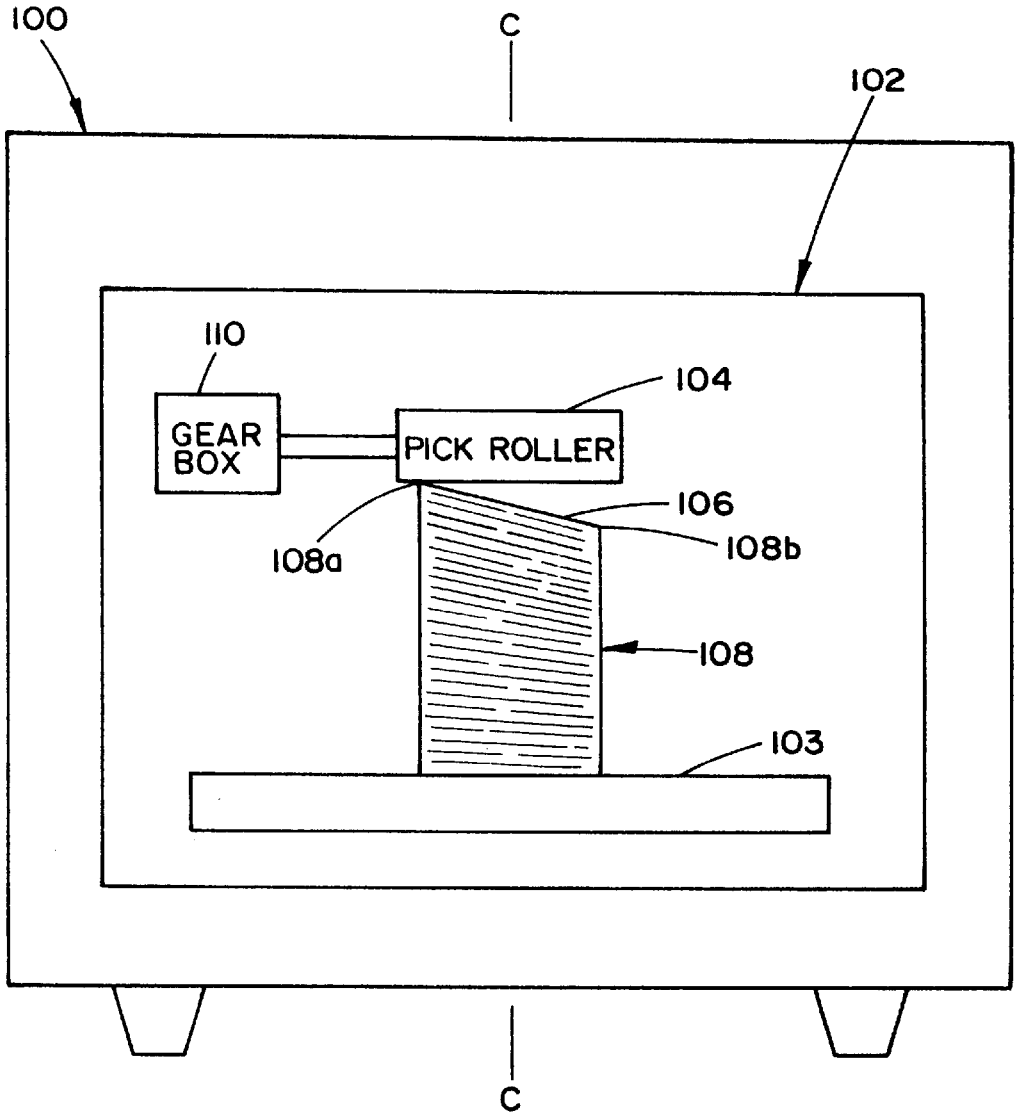
FIG. 1 (PRIOR ART)
FIG. 1 is a side view from a front of a paper feeder of the prior art illustrating a stack of envelopes to be printed thereupon.
Figure 2:
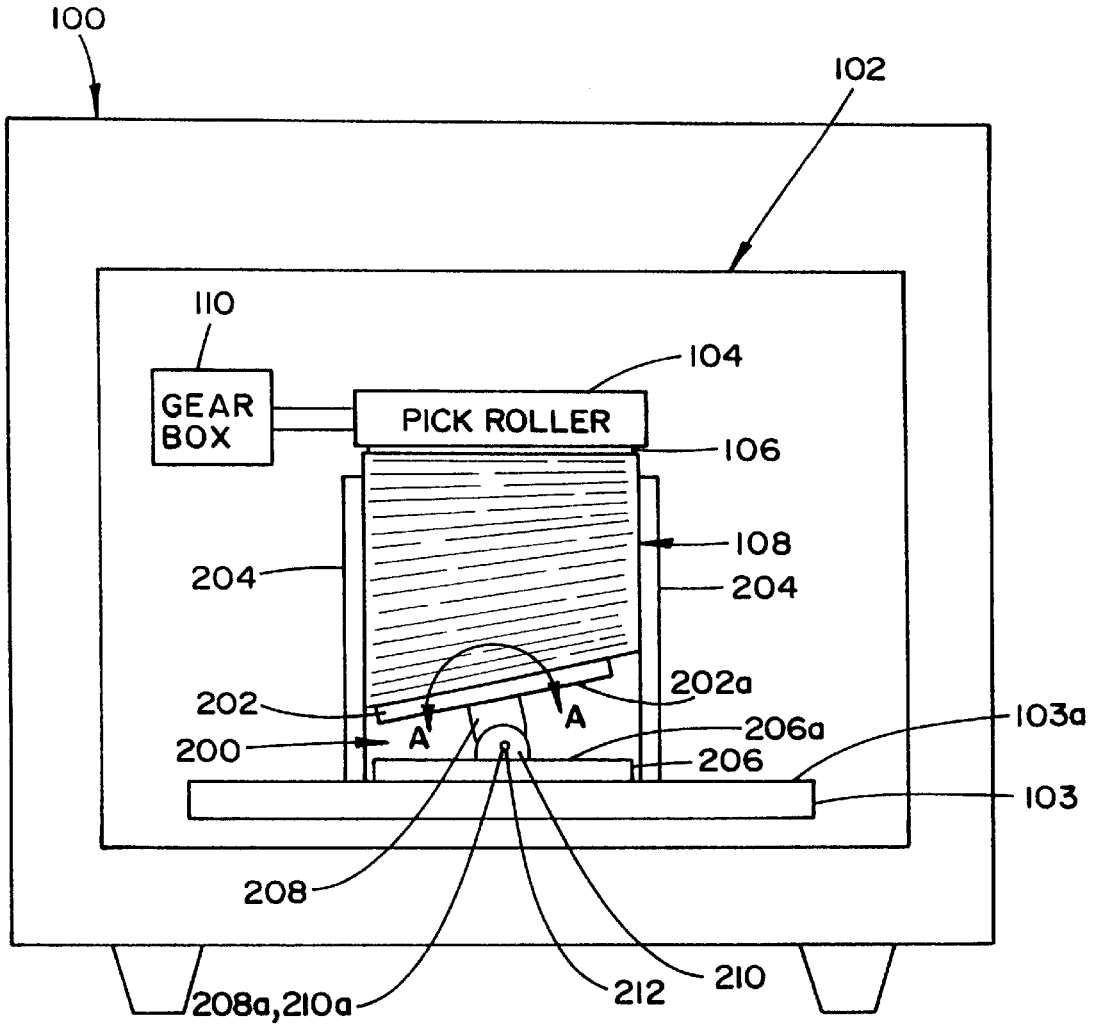
FIG. 2 is a front view illustrating a printer having a printer feeder with a first embodiment of the envelope leveler of the present invention disposed on a surface of the printer feeder.
Figure 3:
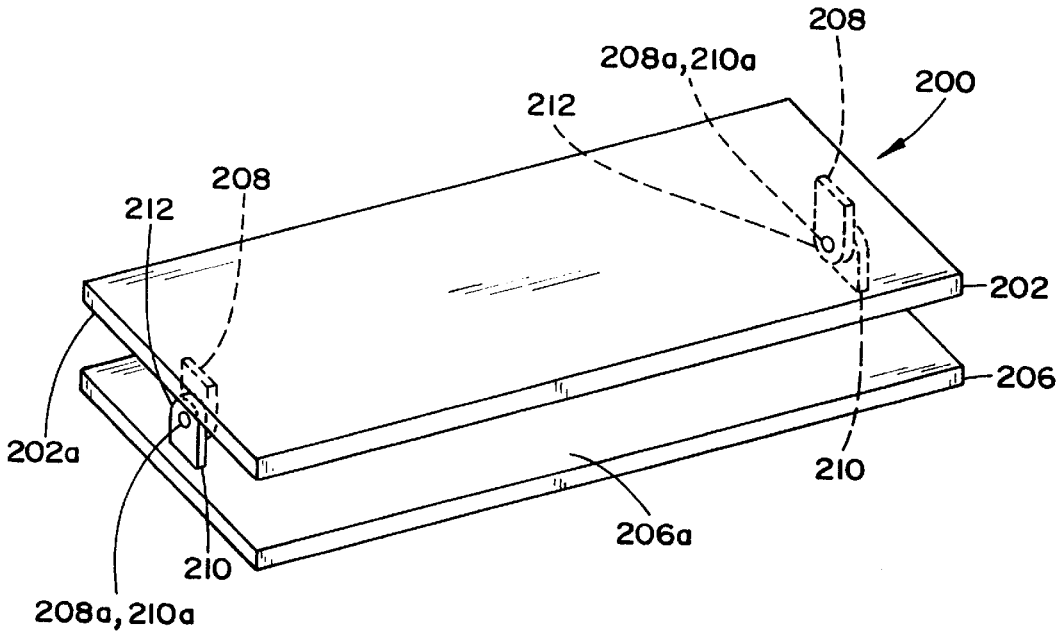
FIG. 3 is an isometric view of the envelope leveler of FIG.2.

Referring now to FIGS. 2 and 3 there is illustrated a first embodiment of the envelope leveler of the present invention generally referred to by reference numeral 200. The envelope leveler 200 is for use with a printer feeder 102 employing a pick roller 104 to orient a top envelope 106 of a stack of envelopes 108 to be fed into a printer 100 attached to the printer feeder 102. The envelope leveler comprises a platform 202 upon which the envelope stack 108 is disposed. The platform 202 is preferably a thin rectangular member having a width substantially equal to or less than the width of the envelope stack 202. In the preferred width, support walls 204, typically supplied with printer feeders 102 can be used to align and support the envelope stack 108.

The envelope leveler 200 also has a base 206. The base 206 is also preferably a thin rectangular member having a width substantially equal to or less than the width of the envelope stack 108 for the same reasons as discussed above with regard to the platform 202. The base 206 preferably sits upon a surface 103*a* of the printer feeder 102, preferably an upper surface of the printer tray 103.

The envelope leveler also has a pivot means for rotating the platform 202 about line A—A and the envelope stack 108 disposed thereupon about the base 206 under pressure from the pick roller 104. Thus, the pivot means allows the platform to freely rotate about the base such that the top envelope of the envelope stack is oriented for proper feeding into the printer. Effectively, the offset in height at the top of the envelope stack 108 is transferred to the bottom of the envelope stack 108 where it does not affect the proper feeding of the envelopes into the printer 100.

In the first embodiment of the envelope leveler of the present invention shown in FIGS. 2 and 3 the pivot means comprises a first tab 208 depending from a lower surface 202*a* of the platform 202. The first tab 208 has a first pivot hole 208*a*. The pivot means also comprises a second tab 210 depending from an upper surface 206*a* of the base 206. The second tab 210 has a second pivot hole 210*a*. The second tab 210 opposes the first tab 208 such that the first pivot hole 208*a* is axially aligned with the second pivot hole 210*a* for disposal of a pivot pin 212 therein. Preferably, as shown in FIG. 3, two pairs of first and second tabs 208, 210 are employed in which each pair pivots about a common axis.

It is apparent to someone skilled in the art that the first embodiment of the envelope leveler 200 of the present invention is easily retrofitted to existing printers 100 and can easily and economically manufactured. It is also apparent to those skilled in the art that the envelope leveler 200 automatically adjusts itself to envelope stacks of different degrees of height unevenness because the platform 202 is freely rotatable under pressure from the pick roller 104.

Figure 4:
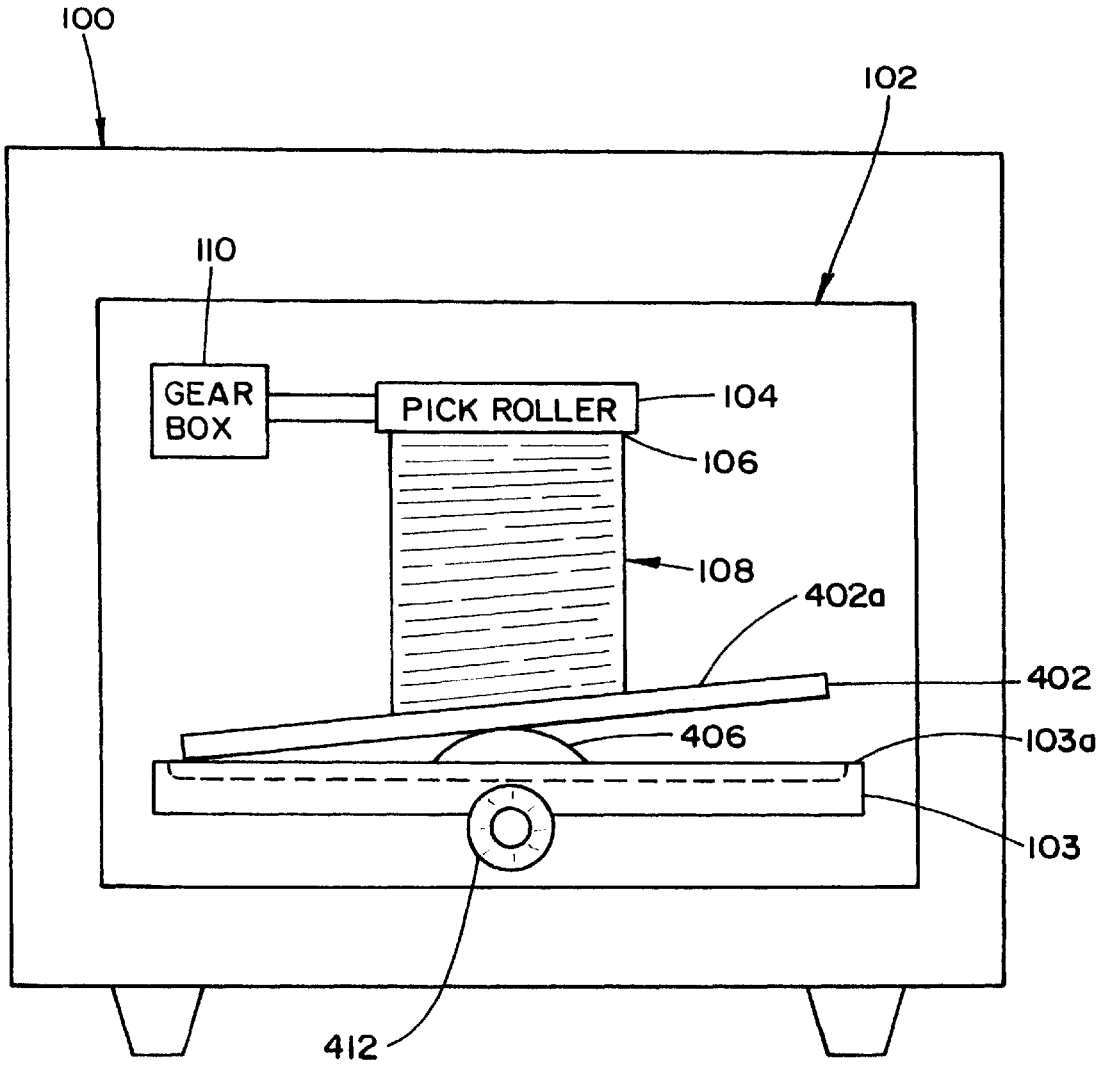
FIG. 4 is a front view illustrating a printer having a printer feeder with a second embodiment of the envelope leveler of the present invention wherein a base of the envelope leveler comprises a surface of the printer feeder.
Figure 5:
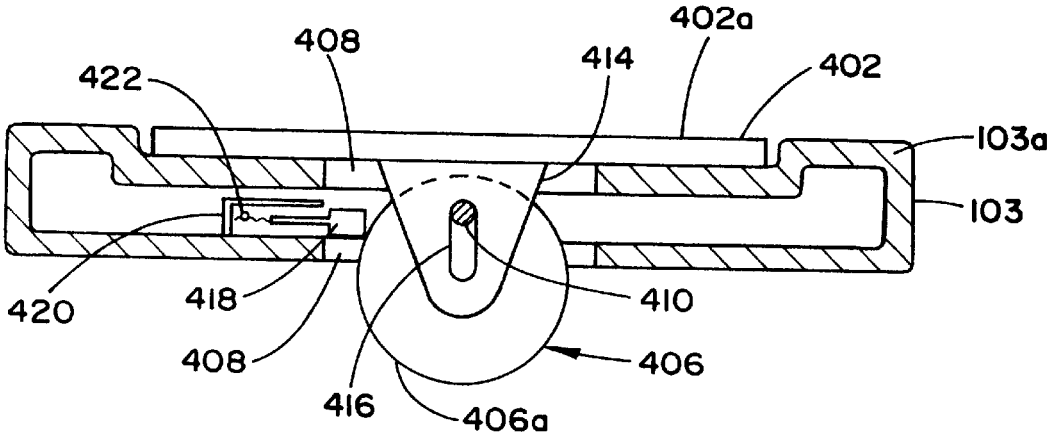
FIG. 5 is a sectional view of the envelope leveler of FIG. 4 shown in a first position wherein a platform of the envelope leveler is parallel to the surface of the printer feeder.
Figure 6:
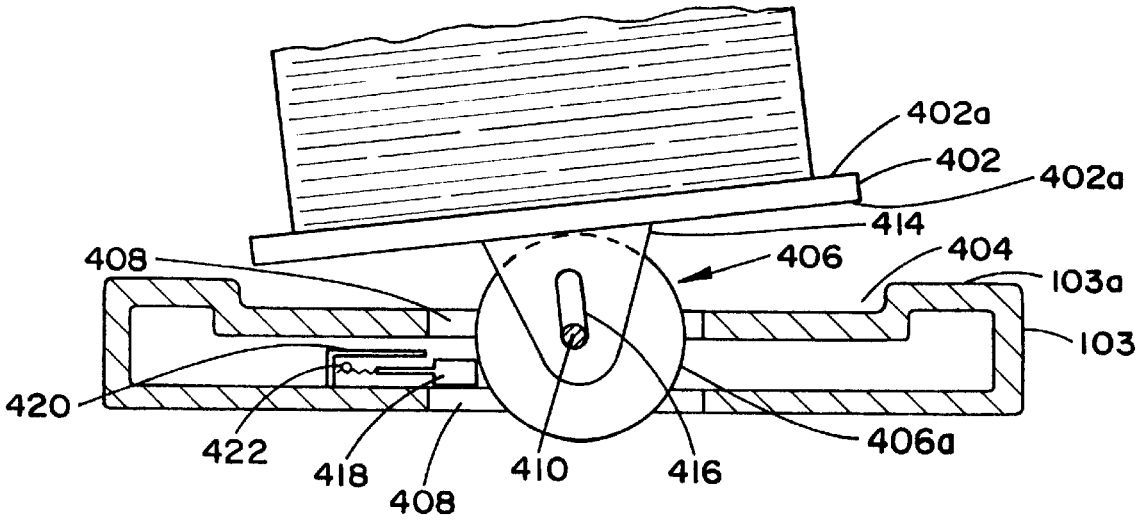
FIG. 6 is a sectional view of the envelope leveler of FIG. 5 shown in a second position wherein the platform is positioned such that the top envelope of the envelope stack is properly oriented for feeding into the printer.

Referring now FIGS. 4, 5, and 6 there is illustrated a second embodiment of the envelope leveler of the present invention, generally referred to by reference numeral 400. The second embodiment of the envelope leveler 400 of the present invention has a platform 402 upon which the envelope stack 108 is disposed. The platform 402 is preferably a thin sheet which lies upon a top surface 103*a* of the printer tray 103 or is contained within a cavity 404 in the printer tray 103 such that a top surface 402*a* of the platform 402 is flush with the top surface 103*a* of the printer tray 103 when the envelope leveler 400 is not being employed, such as when paper sheets (not shown) are being fed into the printer 100. This configuration is clearly illustrated in FIG. 5.

In the second embodiment of the envelope leveler 400 of the present invention, the base comprises a surface of the printer feeder, such as the top surface 103*a* of the printer tray 103.

In the second embodiment of the envelope leveler 400, the pivot means preferably comprises a cam 406 having an outer periphery 406*a* upon which the platform 402 is supported. The cam 406 is rotatably disposed in a slot 408 in the printer tray 103 by means of a shaft 410. The cam 406 is rotatable by means of a knob 412 connected to the shaft between a first position, shown in FIG. 5, wherein the platform 402 is parallel with the top surface 103 of the printer tray 103, and at least a second position, shown in FIG. 6, wherein the top envelope 106 of the envelope stack 108 is oriented for proper feeding into the printer. Thus, the platform 402 teeters on the outer periphery 406*a* of the cam 406 under the pressure of the pick roller 104. To restrain the platform 402 from running off of the platform 402 and to maintain its position in the cavity 404 when it is returned to the first position, third and fourth tabs 414 (only one of which is shown) are employed, one of each on both ends of the cam 406. The third and fourth tabs 414 extend from a lower surface 402*a* of the platform and are captured about the shaft 410 in a slot 416.

A locking means is provided for locking the cam 406 in the second position. The locking means preferably comprises a frictional relationship between the cam 406 and the printer tray 103 or an appendage thereof such that a frictional force between the cam 406 and the printer tray 103 or appendage thereof resists rotation of the cam 406. Preferably, the frictional force is employed by a shoe 418 slidingly housed in a body 420 in the printer tray or attached thereto. The shoe 418 is biased towards the cam 406 by means of a spring 422 causing a frictional force between the shoe 418 and the outer periphery 406*a* of the cam 406.

Other means for locking the platform 402 can be employed without departing from the spirit and scope of the present invention, such as a ball detent arrangement. However, since the outer periphery 406*a* of the cam 406 is a continuous surface the position of the platform 402 can be adjustable and set at any position between the first and second positions and can be maintained thereat by the frictional force.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An envelope leveler for use with a printer feeder employing a pick roller to orient a top envelope of a stack of envelopes to be fed into a printer attached to the printer feeder, the envelope leveler comprising:

a platform upon which the envelope stack is disposed;

a base comprising a surface of the printer feeder, the base having a slot; and a pivot means for rotating the platform and the envelope stack thereupon around the base under pressure from the pick roller such that the top envelope of the envelope stack is oriented for proper feeding into the printer, the pivot means comprising;

a cam having an outer periphery upon which the platform is supported, the cam being rotatably disposed in the slot in the base and having a first position wherein the platform is parallel with the base and at least one second position wherein the top envelope of the envelope stack is oriented for proper feeding into the printer;

rotation means for rotating the cam between the first position and the at least one second position; and locking means for locking the cam in one of the at least one second positions.

2. The envelope leveler of claim 1, wherein the outer periphery of the cam is a continuous surface such that the position of the platform is adjustable between the first and second positions.

3. The envelope leveler of claim 1, wherein the rotation means comprises a knob coupled to the cam and rotatable therewith.

4. The envelope leveler of claim 1, wherein the locking means comprises a frictional relationship between the cam and the base such that a frictional force between the cam and the base resists rotation of the cam.

5. A printer having an envelope leveler for use with a printer feeder employing a pick roller, the printer feeder being attached to the printer, the printer comprising:

a printer feeder having a surface for supporting the stack of envelopes;

means for feeding the top envelope into the printer; and an envelope leveler comprising:

a platform upon which an envelope stack is disposed;

a base comprising the surface of the printer feeder, the base having a slot; and a pivot means for rotating the platform and the envelope stack thereupon around the base under the pressure of the pick roller such that a top envelope of the envelope stack is oriented for proper feeding into the printer, the pivot means comprising:

a cam having an outer periphery upon which the platform is supported, the cam being rotatably disposed in the slot in the base and having a first position wherein the platform is parallel with the base and at least one second position wherein the top envelope of the envelope stack is oriented for proper feeding into the printer;

rotation means for rotating the cam between the first position and the at least one second position; and locking means for locking the cam in one of the at least one second positions.

6. The printer of claim 5, wherein the outer periphery of the cam is a continuous surface such that the position of the platform is adjustable between the first and second positions.

7. The printer of claim 5, wherein the rotation means comprises a knob coupled to the cam and rotatable therewith.

8. The printer of claim 5, wherein the locking means comprises a frictional relationship between the cam and the base such that a frictional force between the cam and the base resists rotation of the cam.

* * * * *